US006855023B2

(12) United States Patent
Berger et al.

(10) Patent No.: US 6,855,023 B2
(45) Date of Patent: Feb. 15, 2005

(54) WAKEBOARD BINDING

(76) Inventors: Richard W. Berger, 219 Farley Dr., Aptos, CA (US) 95003; Brant W. Berger, 1171 San Andreas Rd., LaSelva Beach, CA (US) 95076

( * ) Notice: Subject to any disclaimer, the term of this patent is extended or adjusted under 35 U.S.C. 154(b) by 13 days.

(21) Appl. No.: 10/284,594

(22) Filed: Oct. 30, 2002

(65) Prior Publication Data

US 2003/0057664 A1 Mar. 27, 2003

Related U.S. Application Data

(60) Division of application No. 09/338,118, filed on Jun. 22, 1999, now Pat. No. 6,499,757, which is a continuation-in-part of application No. 08/876,358, filed on Jun. 24, 1997, now Pat. No. 5,913,530.

(60) Provisional application No. 60/020,404, filed on Jun. 25, 1996.

(51) Int. Cl.[7] ..... B63B 35/85

(52) U.S. Cl. ..... 441/70; 280/607; 280/613; 280/618

(58) Field of Search ..... 441/70; 280/607, 280/613, 617, 618

(56) References Cited

U.S. PATENT DOCUMENTS

| | | | | |
|---|---|---|---|---|
| 3,091,043 A | | 5/1963 | McCorkie | 36/8.3 |
| 3,707,047 A | | 12/1972 | Nedwick | 36/2.5 |
| 4,371,188 A | | 2/1983 | Hull | 280/613 |
| 4,463,968 A | | 8/1984 | Hull | 280/613 |
| 4,964,649 A | | 10/1990 | Chamberlin | 280/618 |
| 5,021,017 A | | 6/1991 | Ott | 441/70 |
| 5,028,068 A | | 7/1991 | Donovan | 280/618 |
| 5,035,443 A | | 7/1991 | Kincheloe | 280/618 |
| 5,044,654 A | | 9/1991 | Meyer | 280/613 |
| 5,190,311 A | | 3/1993 | Carpenter et al. | 280/618 |
| 5,261,689 A | | 11/1993 | Carpenter et al. | 280/618 |
| 5,277,635 A | | 1/1994 | Gillis | 441/74 |
| 5,354,088 A | * | 10/1994 | Vetter et al. | 280/618 |
| 5,356,170 A | | 10/1994 | Carpenter et al. | 280/618 |
| 5,392,537 A | | 2/1995 | Goldberg | 36/134 |
| 5,499,837 A | * | 3/1996 | Hale et al. | 280/607 |
| 5,520,405 A | | 5/1996 | Bourke | 280/613 |
| 5,520,406 A | | 5/1996 | Anderson et al. | 280/624 |
| 5,553,883 A | | 9/1996 | Erb | 280/607 |
| 5,577,755 A | | 11/1996 | Metzger et al. | 280/607 |
| 5,586,779 A | | 12/1996 | Dawes et al. | 280/14.2 |
| D380,289 S | | 7/1997 | Sand | D2/959 |
| D382,320 S | | 8/1997 | Sand | D21/230 |
| 5,722,680 A | | 3/1998 | Dodge | 280/624 |
| 5,765,853 A | | 6/1998 | Erb | 280/607 |
| 5,913,530 A | * | 6/1999 | Berger et al. | 280/607 |
| 6,499,757 B1 | * | 12/2002 | Berger et al. | 280/607 |

FOREIGN PATENT DOCUMENTS

| | | | |
|---|---|---|---|
| DE | 2501878 | 7/1975 | 280/613 |
| FR | 2604913 | 4/1988 | |
| WO | WO 96/41663 | 12/1996 | |

* cited by examiner

*Primary Examiner*—S. Joseph Morano
*Assistant Examiner*—Lars A. Olson
(74) *Attorney, Agent, or Firm*—Beyer Weaver & Thomas

(57) ABSTRACT

A method is provided for coupling a shoe worn by a user onto a coupling mount on a wakeboard by a step-in action. A binding comprises a coupler on either the shoe or wakeboard and a corresponding coupling mount on the other of the shoe or wakeboard to receive the coupler.

5 Claims, 5 Drawing Sheets

WAKEBOARD BINDING

REFERENCE TO RELATED APPLICATIONS

This is a division of application Ser. No. 09/338,118 filed Jun. 22, 1999 now U.S. Pat. No. 6,499,757, which is a continuation-in-part of Application Ser. No. 60/020,404, filed Jun. 25, 1996 now abandoned and application Ser. No. 08/876,358, filed Jun. 24, 1997 now U.S. Pat. No. 5,913,530, which are incorporated by reference in their entirety.

The present invention relates to wakeboarding and more specifically to a step-in binding mounting a shoe, e.g., a boot or sandle, to a wakeboard.

BACKGROUND OF THE INVENTION

Wakeboarding is a sport which combines aspects of surfing, water skiing, skateboarding, and snowboarding. The wakeboard is longer than a skateboard but shorter than a surfboard and is used as a single water ski. Typically, boots which receive the rider's feet are mounted to the wakeboard and require the rider to strap his or her feet into the boots.

The stance position of a rider's feet on the wakeboard refers to the angular relationship formed between the mid-line (lengthwise) of the rider's foot and the midline (lengthwise) of the wakeboard itself. The stance position is selected by the rider setting the boots in a particular fixed relationship to the wakeboard during downtime of the wakeboard.

SUMMARY OF THE INVENTION

The wakeboard binding of the invention permits quick coupling and release of the rider's shoe to and from the wakeboard at the rider-selected angular stance position. The binding comprises a coupler for attachment to either a shoe or a wakeboard, a corresponding coupling mount attached to the other of the shoe or wakeboard. Either the coupler or the coupling mount includes a locking member, and the other includes an opening for receiving the locking member. The coupling mount and coupler are configured to engage with each other to lock the shoe onto the wakeboard while the user is wearing the shoe by a step-in motion. When engaged the locking member received within the opening prevents rotation of the shoe relative to the wakeboard. A method is provided for attaching a shoe to a wakeboard comprising the step of lockingly engaging a coupler attached to a user's shoe to a coupler mount attached to a wakeboard by the act of the user wearing the shoe stepping onto the coupling mount on the wakeboard.

DESCRIPTION OF THE PREFERRED EMBODIMENTS

Figure 1:
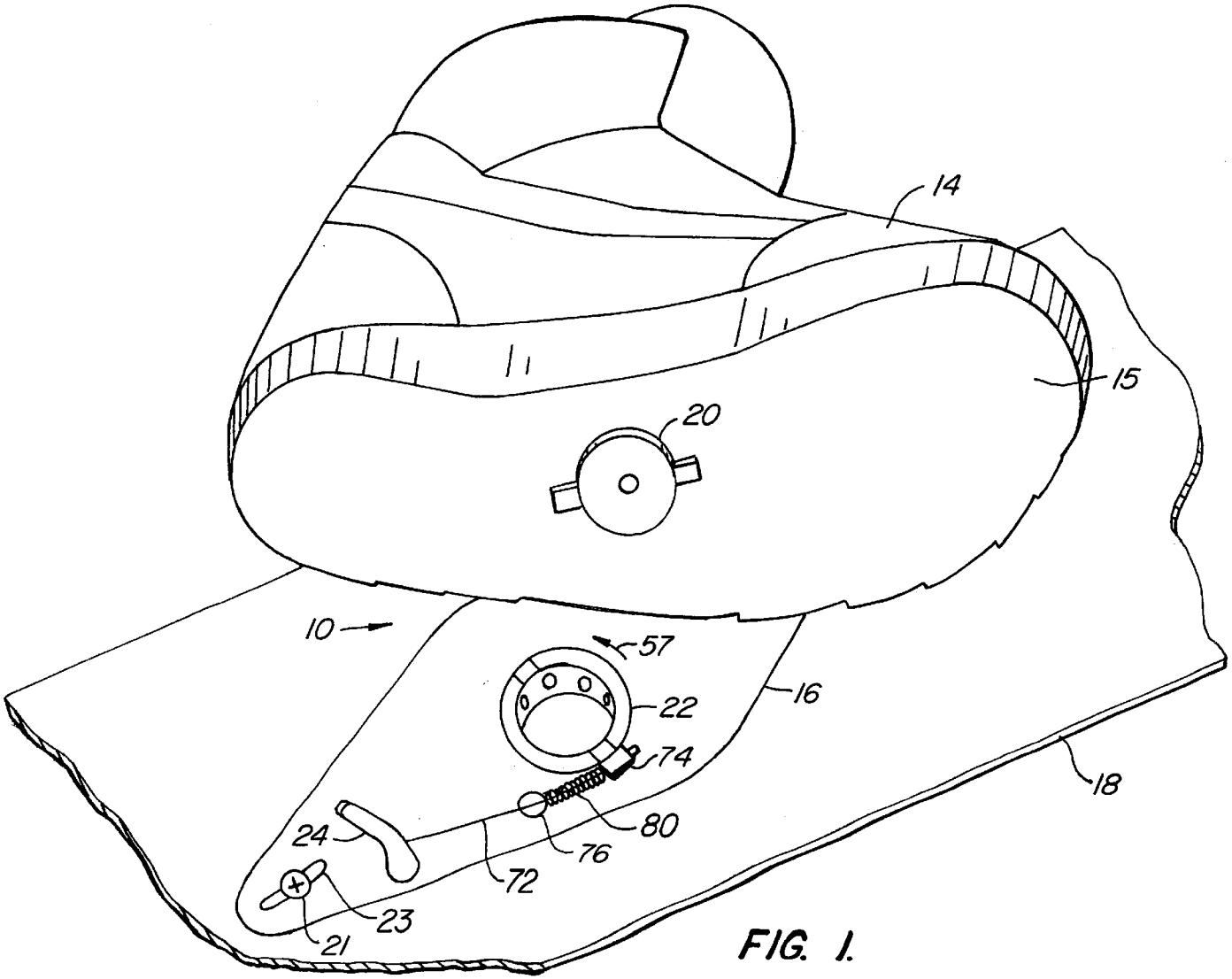
FIG. 1 is a diagrammatic illustration of the binding of the invention shown attached to a boot and a wakeboard.

Referring to FIG. 1, a wakeboard binding 10 includes a lower attachment plate 16 connected to a wakeboard 18, a coupling mount 22 attached to lower plate 16, and a coupler 20 attached to a shoe, e.g., a sandle or boot 14. Coupling mount 22 and coupler 20 engage with each other to lock coupler 20 to the lower plate 16 when a user wearing boot 14 steps onto lower plate 16. Coupling mount 22 and coupler 20 are disengaged simply by actuating a handle 24. This releases coupler 20 from lower plate 16 permitting the user to step off of board 18.

To attach lower plate 16 to board 18, screws 21 are provided which pass through screw slots 23 in plate 16, on either end of plate 16 (only one screw and slot being shown), and screw into binding mount holes (not shown) in board 18.

Figure 2:
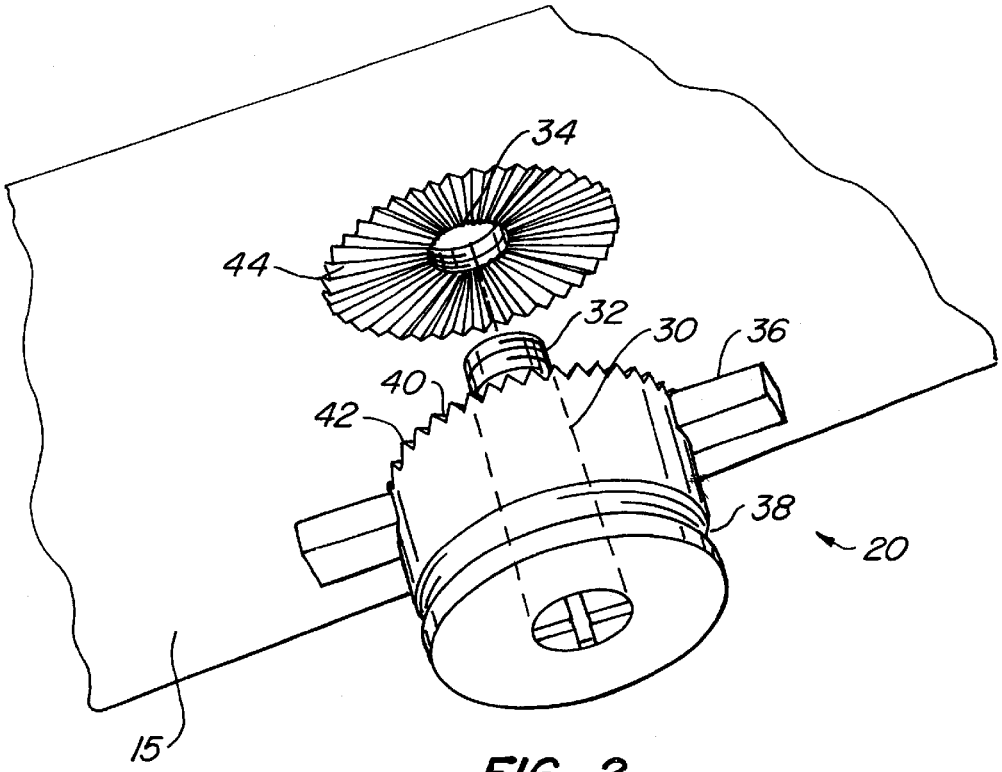
FIG. 2 is a perspective view of an upper coupler of the binding of FIG. 1.

Referring to FIG. 2, coupler 20 is generally cylindrically shaped and includes a cross-bar 36 and a circumferential channel 38, for purposes described below. To attach coupler 20 to boot 14, a bolt 32 is received within a through bore 30 in coupler 20 and a threaded hole 34 in sole 15 of boot 14. When attaching coupler 20 to boot 14, the alignment of cross-bar 36 relative to the boot can be set at any desired angle. The upper surface 40 of coupler 20 can include serrations 42, and boot sole 15 can have corresponding serrations 44 to help maintain coupler 20 at the desired angle.

Figure 3:
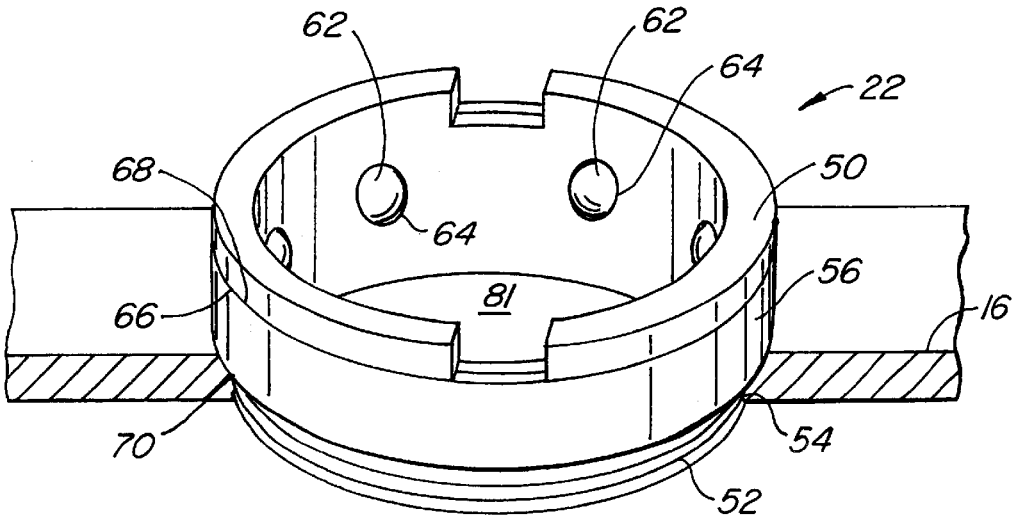
FIG. 3 is a perspective view of a lower attachment plate and coupling mount of the binding of FIG. 1, shown partially in cross-section.
Figure 3A:
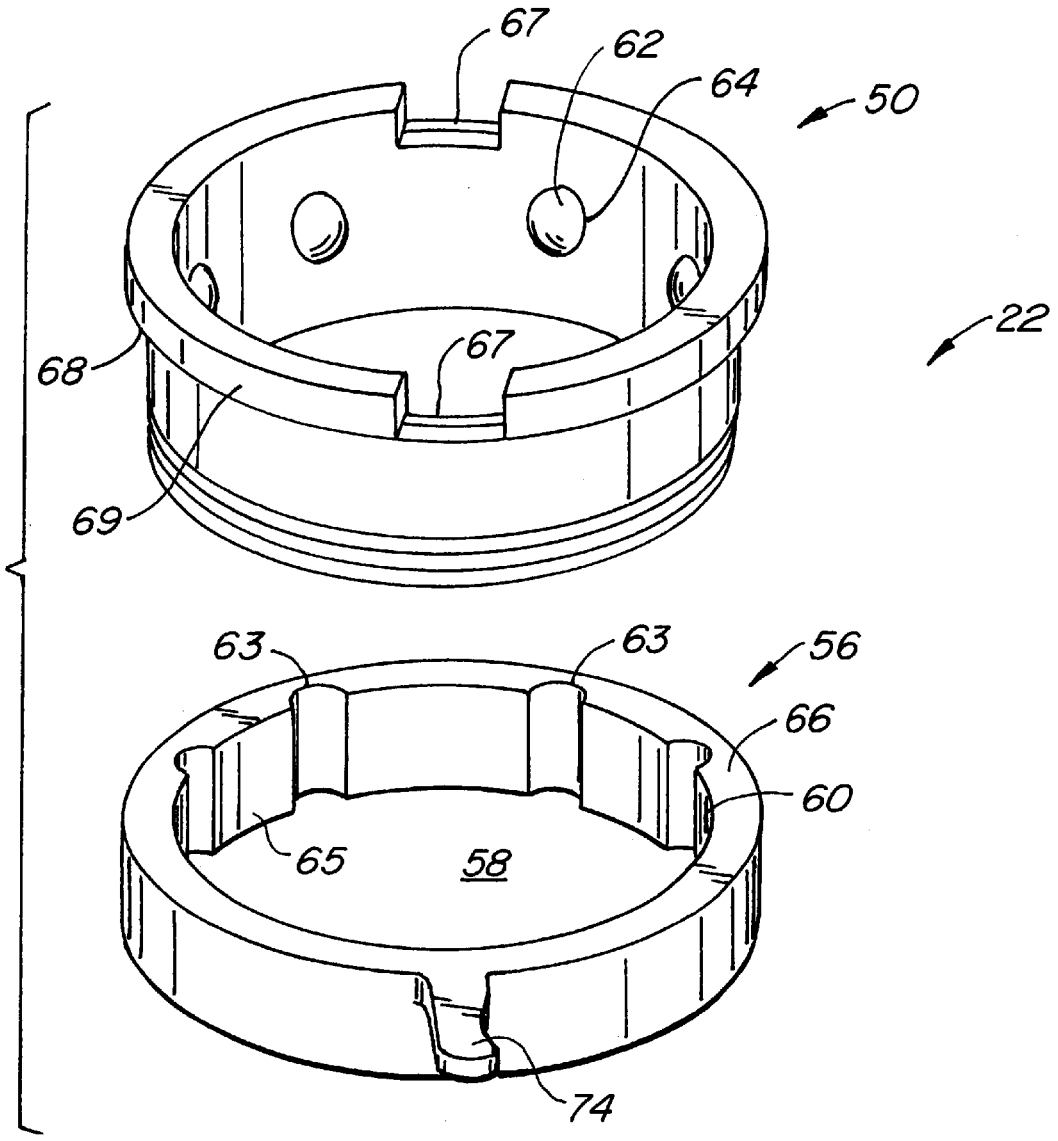
FIG. 3A is an exploded view of the coupling mount.

Referring to FIGS. 3 and 3A, coupling mount 22 includes a sleeve 50 having a threaded end 52 which is received within a threaded opening 54 of lower plate 16 to attach coupling mount 22 to lower plate 16. Coupling mount 22 also includes an outer bearing collar 56 having a through bore 58 defined by an inner wall 60. When assembled, sleeve 50 is located within bore 58 of collar 56. Ball bearings 62 are located in apertures 64 which extend through sleeve 50. With collar 56 placed over sleeve 50 such that an end 66 of collar 56 abuts a shelf 68 of sleeve 50 defined by an area of increased diameter 69, ball bearings 62 can contact inner wall 60 of collar 56. Inner wall 60 includes bearing cutouts 63 and flat walled sections 65, for purposes described below. It is the interaction between ball bearings 62 and inner wall 60 which acts to lock coupler 20 to lower plate 16. Sleeve 50 also includes upper slots 67, for purposes described below.

A washer 70 is positioned between lower plate 16 and collar 56. Collar 56 is trapped between washer 70 and shelf 68 but remains rotatable relative to sleeve 50. Referring again to FIG. 1, to rotate collar 56, handle 24 is coupled to collar 56 by a cable 72 which extends from handle 24 to an extension 74 of collar 56. An extension spring 80, for example, formed of spring stainless steel, is located between extension 74 and a stop 76 and applies a force to extension 74 acting to bias collar 56 in a counter-clockwise direction (arrow 57) such that flat surfaces 65 of inner wall 60 abut ball bearings 62, biasing ball bearings 62 inward.

When attaching boot 14 to board 18, the user actuates handle 24 such that collar 56 rotates clockwise to an open, coupler 20 receiving position. The clockwise rotation aligns bearing cutouts 63 in collar 56 with ball bearings 62. The user then steps onto lower plate 16 and coupler 20 pushes ball bearings 62 outward biasing the ball bearing into cutouts 63 as coupler 20 is received within a bore 81 of coupling mount 22. When the user releases handle 24, collar 56 rotates counter-clockwise to a closed, coupler 20 locking position, under the force of spring 80 causing flat portions 65 of wall 60 to abut ball bearings 62 biasing ball bearings 62 inward. This forces ball bearings 62 into circumferential channel 38. The action of spring 80 effectively locks coupler 20 to coupling mount 22 by biasing ball bearings 62 inward into channel 38.

When stepping onto lower plate 16, the user aligns cross-bar 36 of coupler 20 with slots 67 in coupling mount 22. Positioning cross bar 36 within slots 67 prevents rotating of coupler 20 relative to coupling mount 22. To remove boot 14 from board 18, the user actuates handle 24, rotating collar 36 such that cutouts 63 are aligned with ball bearings 62. By pulling up on boot 14, ball bearings 62 are forced out of channel 38 in coupler 20 and boot 14 can be removed from board 18. To change the angle of boot 14 relative to board 18, the user loosens screw 32, rotates coupler 20 to the desired angle, and retightens screw 32.

Figure 4:
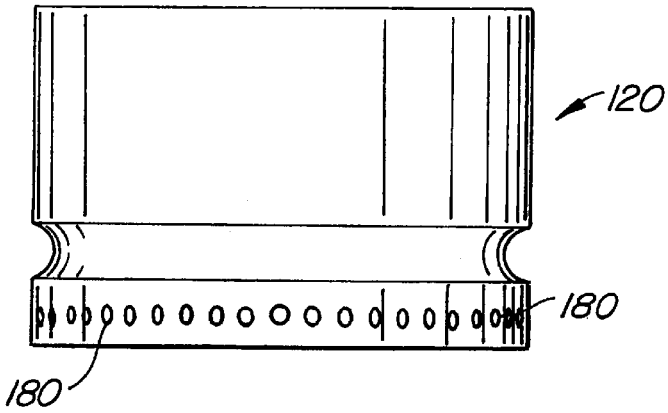
FIG. 4 is a side view of an alternative embodiment of the upper coupler of the binding of FIG. 1.
Figure 5:
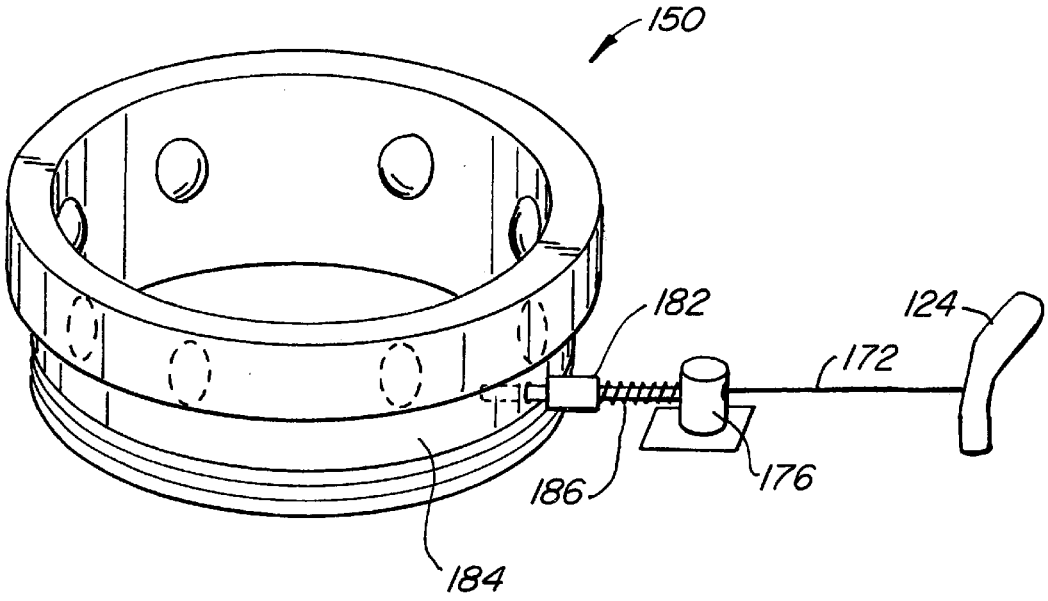
FIG. 5 is a perspective view of an alternative embodiment of the coupling mount of the binding of FIG. 1.

Referring now to FIGS. 4 and 5 of the drawings, there is shown a coupler 120 and a coupling mount sleeve 150 which permit angular adjustment of boot 14 relative to board 18 while the boot is locked to the board. Here, sleeve 120 does not include a cross bar 36 and sleeve 150 does not include slots 67. Thus, with coupler 120 locked to lower plate 16, coupler 120 is free to rotate relative to lower plate 16.

To prevent rotation of coupler 120 when a desired orientation of boot 14 relative to board 18 is selected, coupler 120 includes locking holes 180. A locking pin 182 passing through wall 184 of sleeve 150 is selectively engageable with a corresponding hole 180. To move pin 182, a handle 124 is coupled to pin 182 by a cable 172 which extends from handle 24 to pin 182. An extension spring 186, for example, formed of spring stainless steel, is located between pin 182 and a stop 176 and applies a force to pin 182 acting to bias pin 182 inward into engagement with the corresponding hole 180.

To adjust the alignment of boot 14, the user actuates handle 124, pulling pin 182 out of the corresponding hole 180, rotates boot 14 while remaining attached to board 18, and then releases handle 124 such that pin 182 engaging the new corresponding hole 182 locking boot 14 in its new orientation.

Figure 6:
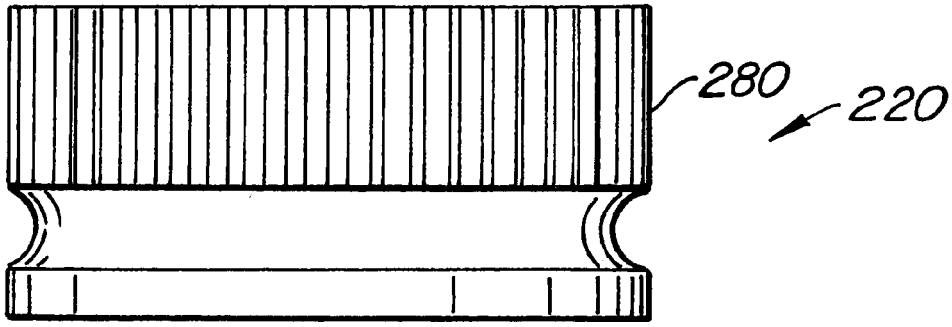
FIG. 6 is a side view of an alternative embodiment of the upper coupler of the binding of FIG. 1.
Figure 7:
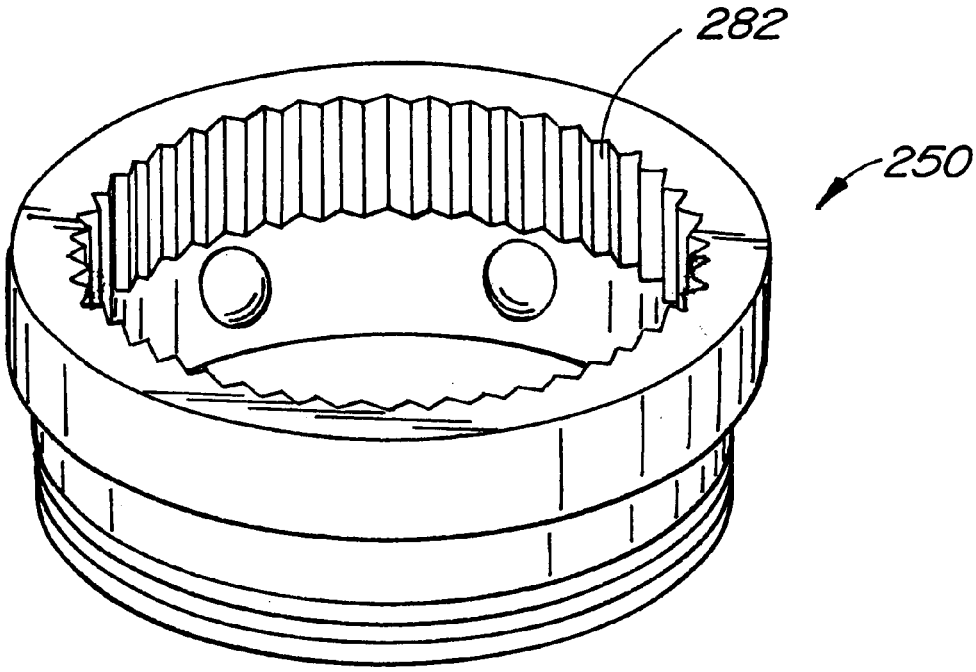
FIG. 7 is a perspective view of an alternative embodiment of the coupling mount of the binding of FIG. 1.

Referring now to FIGS. 6 and 7, there is shown a coupler 220 including splines 280 and a sleeve 250 including corresponding splines 282 for rotationally locking boot 14 relative to board 18. The user can change the orientation of boot 14 relative to board 18 by stepping out of the binding, as described above with reference to FIGS. 1–3, rotating the user's foot, and stepping back into the binding.

Couplers 120 and 220 can be mounted to boot 14 by means other than screw 32, e.g., using two screws, since rotation of coupler 120 relative to boot 14 is not required to change the orientation of boot 14 relative to board 18. Serrations 42 and 44 (FIG. 2) would not be used in the embodiments of FIGS. 4–7.

Other embodiments are within the scope of the following claims. For example, the coupler can be mounted to the boot such that the board facing side of the coupler lie flush with or inset with the surface of boot sole. The coupler can be attached to the board and the coupler mount attached to the boot.

What is claimed is:

1. A method of attaching a shoe to a wakeboard, comprising:

providing a first coupler attached to a user's shoe, providing a second coupler attached to a wakeboard, lockingly engaging the first and second couplers by the act of the user wearing the shoe stepping onto the wakeboard, selecting a desired angular orientation of said shoe relative to said board and fixing said shoe to a said board at said desired angular orientation, and changing said angular orientation by rotating said shoe relative to said board when the shoe is locked to the board.

2. A method of claim 1 further comprising placing one of said first and second couplers in an open position for receiving the other of said first and second couplers prior to lockingly engaging the first and second couplers.

3. The method of claim 1 wherein the act of stepping onto the wakeboard inserts one of the fist and second couplers into the other of the first and second couplers.

4. The method of claim 1 further comprising actuating a handle to disengage said first coupler from said second coupler to remove the shoe from the board.

5. The method of claim 1 further comprising disengaging said shoe from said board to change said angular orientation.

* * * * *